US006026533A

United States Patent [19]

Prohoroff

[11] Patent Number: 6,026,533

[45] **Date of Patent: *Feb. 22, 2000**

[54] ROTARY BRUSH PLATE APPARATUS

[76] Inventor: Phillip W. Prohoroff, 5022 N. 54th Ave. #10, Glendale, Ariz. 85301

[ * ] Notice: This patent is subject to a terminal disclaimer.

[21] Appl. No.: 09/020,633

[22] Filed: Feb. 9, 1998

Related U.S. Application Data

[63] Continuation-in-part of application No. 08/855,485, May 13, 1997, Pat. No. 5,737,793.

[51] Int. Cl.[7] ..... A46B 13/02

[52] U.S. Cl. ..... 15/180; 15/87

[58] Field of Search ..... 15/87, 176.1–176.6, 15/202, 180

[56] References Cited

U.S. PATENT DOCUMENTS

| | | | |
|---|---|---|---|
| 1,564,226 | 12/1925 | Finnell | 15/180 |
| 2,853,729 | 9/1958 | Link | 15/180 |
| 2,917,767 | 12/1959 | Lechene | 15/180 |
| 3,101,501 | 8/1963 | Horton et al. | 15/180 |
| 3,678,530 | 7/1972 | Horton et al. | 15/180 |
| 3,758,908 | 9/1973 | Maltarp | 15/180 |
| 3,766,589 | 10/1973 | Arenas | 15/180 |
| 3,875,607 | 4/1975 | Rosseau | 15/180 |
| 4,765,013 | 8/1988 | Lowe | 15/180 |
| 4,854,002 | 8/1989 | Smith | 15/176.6 |

*Primary Examiner*—Mark Spisich
*Attorney, Agent, or Firm*—H. Gordon Shields

[57] ABSTRACT

Rotary brush apparatus usable in the environment of a street sweeper includes a generally circular plate to which are secured brush segments. The brush segments are secured to the plate by pins and lock plates movable vertically upwardly in response to rotation of a bolt. The use of the pin and bolt elements allow for the quick change of the brush segments. The lock plates move vertically upwardly and downwardly and are locked in place to keep from rotating by guide elements used for alignment purposes. Apertures in the plate allow for the visual alignment of the brush segments. Pins extend through apertures in the brush segments. The pins may be secured to the lock plates or may be free pins insertable through both the brush segments and apertures in the lock plates.

13 Claims, 3 Drawing Sheets

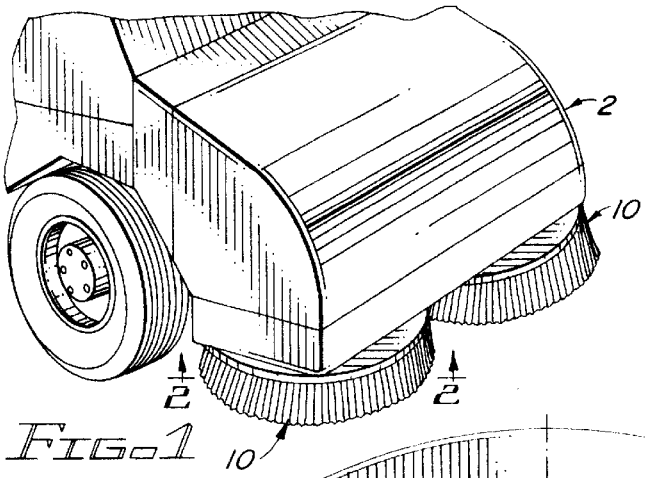
FIG. 1
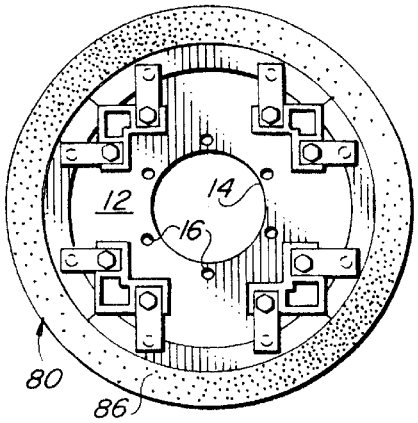
FIG. 2
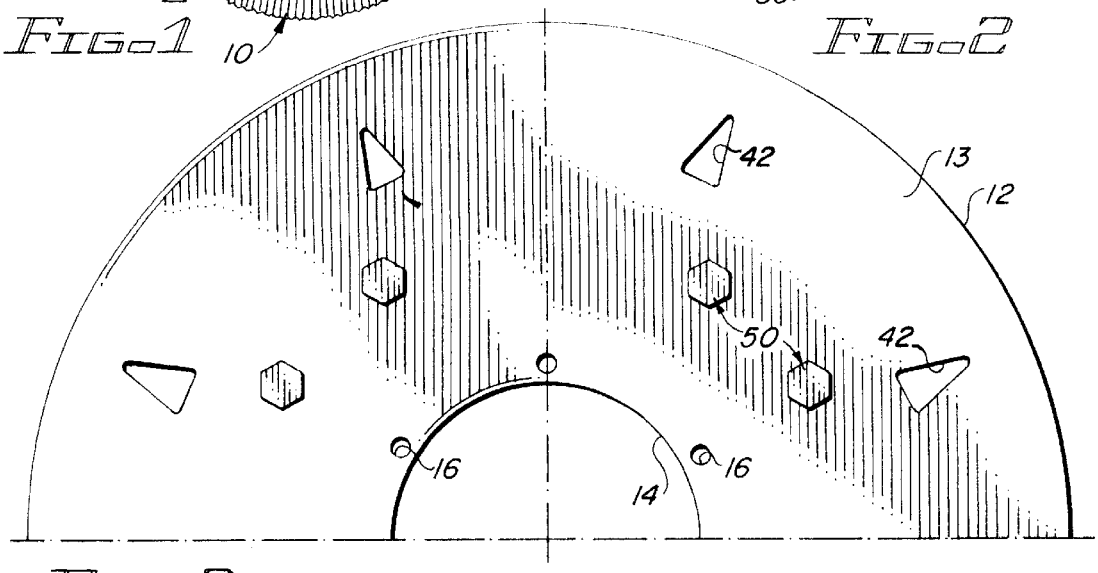
FIG. 3
FIG. 4
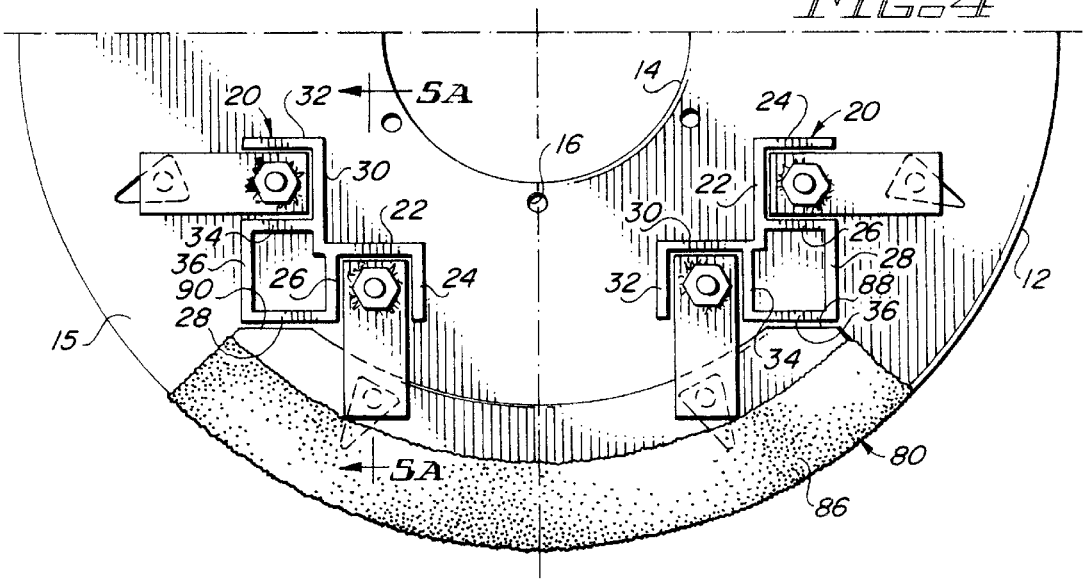

ROTARY BRUSH PLATE APPARATUS

CROSS REFERENCE TO RELATED APPLICATION

This application is a Continuation-in-Part application of Ser. No. 08/855,485, which was filed May 13, 1997, U.S. Pat. No. 5,737,793.

BACKGROUND OF THE INVENTION

1. Field of the Invention

This invention relates to rotary brush apparatus and, more particularly, to a plate for holding a rotary brush and for securing brush holding segments to the plate.

2. Description of the Prior Art

U.S. Pat. No. 2,853,729 (Link) discloses a brush assembly adaptable for use with a brush sweeper. The apparatus includes a plate with brush segments bolted directly to the plate. The apparatus of the '729 patent appears to be the well known prior in contemporary usage.

U.S. Pat. No. 2,917,767 (Lechene) discloses brush or broom elements usable with a rotary street sweeper.

U.S. Pat. No. 3,101,501 (Horton et al) discloses a rotary broom apparatus which includes both broom segments and elements for securing the broom segments to a broom backing plate.

U.S. Pat. No. 3,678,530 (Hotton et al) discloses a hollow plastic holder for holding wire bristles for a rotary brush broom. The bristle holder or bristle segments are in turn secured to a plate to comprise a rotary brush or broom assembly.

U.S. Pat. No. 3,766,589 (Arenas) discloses rotary brush apparatus in which a bottom plate is used to secure brush or broom segments to a top plate. The segments are bolted between the bottom and top plates.

U.S. Pat. No. 3,875,607 (Rosseau) discloses brush segments secured to a segment holder plate. Spring latch elements are used instead of bolts for securing the brush segments to a plate.

U.S. Pat. No. 4,765,013 (Lowe) discloses brush segments for a gutter broom in which the brush segments are again secured to a plate without bolt elements. The '607 and the '813 patents are assigned to the same assignee, and the '013 patent may be considered as a second generation of the '607 patent.

U.S. Pat. No. 4,854,002 (Smith) discloses another type of apparatus for locking brush segments to a carrier plate without the use of bolts. Pivoting elements with springs, are used to secure the brush segments to the carrier plate.

SUMMARY OF THE INVENTION

The invention described and claimed herein comprises a brush assembly for rotary sweeper including a plate for holding a plurality of brush segments and pin elements for indexing the brush segments on the plate. The pin elements extend into the brush segments. Lock plates are movable upwardly and downwardly in response to rotation of a bolt. Guide elements are secured to the plate for helping to align the brush segments. Apertures in the plate allow a mechanic to visually assist in the alignment of the pins with the brush segments for securing the brush segments to the plate.

Among the objects of the present invention are the following:

To provide new and useful rotary brush apparatus;

To provide new and useful rotary brush apparatus having a plurality of segments securable to a plate;

To provide new and useful apparatus for securing brush segments to a plate;

To provide new and useful brush segments and pin elements to align the brush segments to a plate for securing the brush segments to a plate; and To provide new and useful rotary brush apparatus utilizing lock elements movable in response to rotation of a threaded element and pins associated with the lock element extend through brush segments to secure the brush segments to a plate.

BRIEF DESCRIPTION OF THE DRAWING

FIG. 1 comprises a perspective view of a portion of an apparatus illustrating the use environment of the apparatus of the present invention.

FIG. 2 is a bottom view of the apparatus of the present invention taken generally along line 2—2 of FIG. 1.

FIG. 3 is a top view of a portion of the apparatus of the present invention.

FIG. 4 is a bottom view of the apparatus illustrated in FIG. 3.

DESCRIPTION OF THE PREFERRED EMBODIMENT

FIG. 1 is a perspective view of a portion of a street sweeper 2 with a pair of brush assemblies 10 secured to the front and side of the sweeper 2. FIG. 1 comprises the use environment of the apparatus of the present invention.

Figure 5A:
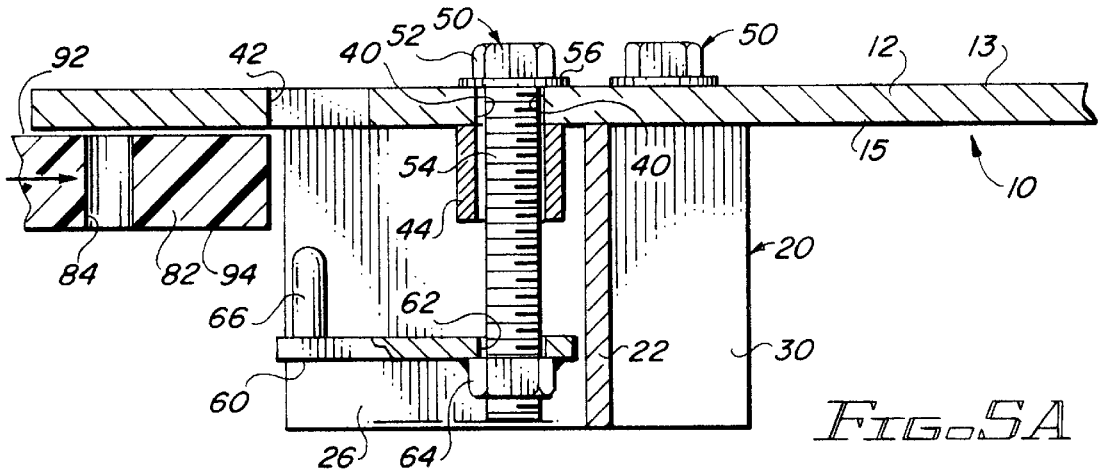
FIG. 5A is a view in partial section taken generally along line 5A—5A of FIG. 4.
Figure 5B:
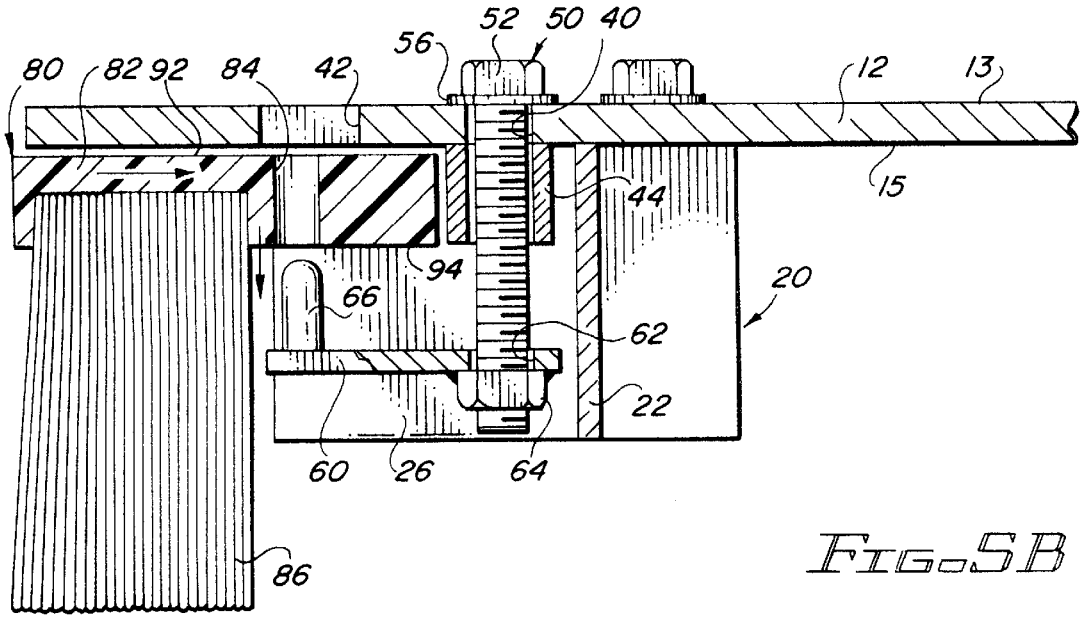
FIG. 5B is a view in partial section sequentially following FIG. 5A.
Figure 5C:
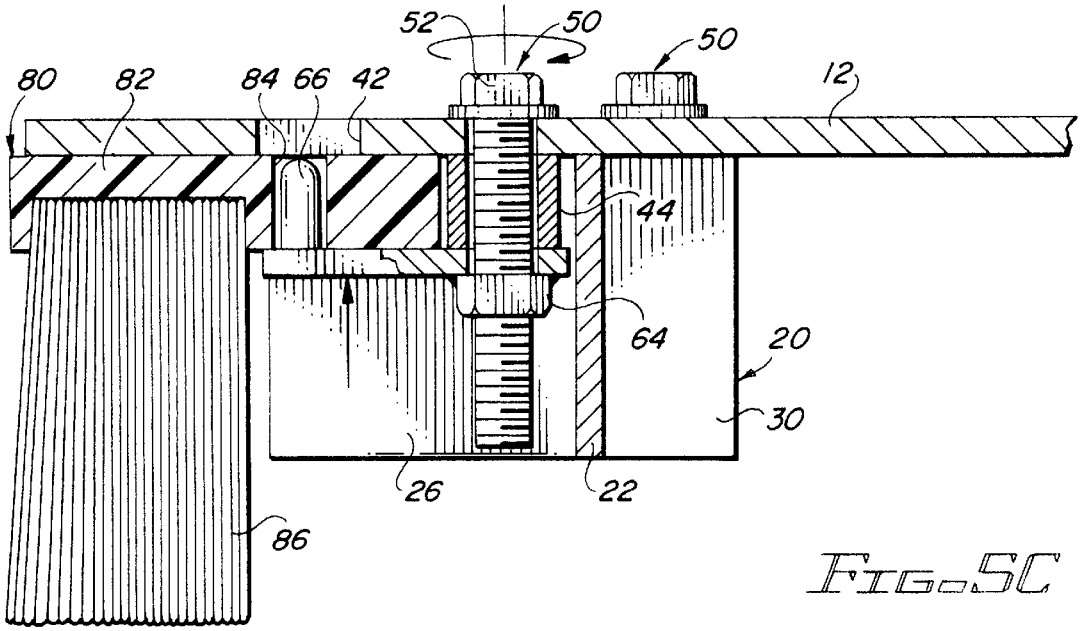
FIG. 5C is a view in partial section sequentially following FIG. 5B.

FIG. 2 comprises a bottom view of a brush assembly 10 taken generally along line 2—2 of FIG. 1. A brush assembly 10 includes a base plate or disk 12 which has a top surface 13 and a bottom surface 15. Four brush segments 80 are secured to or against the bottom surface 15. FIGS. 3 and 4 comprise respectively a top view of half of a base plate 12 and a bottom view of half of a base plate 12, with the associated elements shown. FIGS. 5A, SB and 5C sequentially illustrate the securing of a brush segment 80 to the bottom surface 15 of the plate 12. For the following discussion, reference will be made to FIGS. 2, 3, 4, and to FIGS. 5A, 5B, and 5C.

The plate or disk 12 to which the brush segments 80 are secured is a generally circular plate made of steel. Extending through the plate 12 is a central aperture 14. A plurality of bolt holes 16 are disposed about the central aperture 14. The central aperture 14 and bolt holes 16 are used to secure the plate 12 to rotary apparatus on the sweeper 2 which rotates the brush assemblies 10.

On the bottom 15 of the plate or disk 12 are brackets 20. Each bracket 20 includes arms 22 and 30. A pair of legs 24 and 26 extending outwardly generally perpendicular to the arm 22. At right angles to the arm 22 is the arm 30. The arm 30 includes a pair of legs 32 and 34 extending outwardly generally perpendicular to the arm 30. Support webs 28 and 36 extend outwardly from the legs 26 and 34, respectively. The support webs 28 and 36 are secured together remote from their respective legs 26 and 34.

Between the legs 24 and 26 and the legs 32 and 34 are disposed lock plates 60. The arms with their legs comprise guide elements in which the lock plates 60 move upwardly and downwardly. An aperture 62 extends through a lock plate 60 at one end. A threaded nut 64 is appropriately secured to the plate beneath the aperture 62. The thickness of the nut 64 provides strength to the plate with respect to the bolt 50. If the plate 60 were thick enough to provide strength for internal threads, the aperture 62 could be tapped and the nut 64 could be eliminated.

Each lock plate 60 of the pair of adjacent lock plates 60 is constrained to move vertically in the generally U-shaped channels defined respectively by the arm 22 and legs 24 and 26 and the arm 30 and its legs 32 and 34. The lock plate 60 includes a generally flat top surface.

Extending through the plate 12 are holes or apertures 40 through which extend bolts 50. Secured to the bottom of the plate 12 and coaxially aligned with the holes or apertures 40 are sleeves 44. The sleeves 44 act as guides for the bolts 50. The sleeves 44 also serve to help support the bolts 50 structurally in case of a lateral shock or load imposed on the bolts through the brush segments when the brush segments accidentally contact a curb or other resistance in the use of the sweeper 2.

Remote from the aperture 62 is a pin 66. The pin 66 extends upwardly from the top surface of the plate 60 to which it is appropriately secured. The pin 66 is generally parallel to the sleeve 44 and the bolt 50.

The lock plate 60 moves upwardly and downwardly in response to rotation of a bolt 50. The bolt 50 includes a head 52 which is disposed on the top surface 13 of the plate 12. The bolt 50 includes a threaded shank 54 which extends through the aperture 40 in the plate 12.

A lock washer 56 is disposed between the head 52 of the bolt 50 and the top surface 13 of the plate 12. The threaded shank 54 extends through the sleeve 44 on the bottom 15 of the plate 12, through the aperture 62, and threadedly engages the nut 64. Rotation of the bolt 50 by its head 52 will cause the lock plate 60 to move upwardly and downwardly in a generally vertical orientation. Since the plate 60 is constrained by an arm and its legs of the guide bracket 20, the plate 60 does not rotate.

Disposed adjacent to the bolt apertures 40 are viewing apertures 42. The viewing apertures 42 extend through the plate 12 and are aligned with the pins 66 of the lock plates 60. Thus, a worker changing the brush segments 80 on the plate 12 will be able to view a pin 66 through an aperture 42 for alignment purposes. This may best be understood with reference to FIGS. 5A, 5B, and 5C.

Each brush segment 80 includes a brush carrier plate 82 through which extends a pair of apertures 84. The apertures 84 receive the pins 66 of the lock plates 60. Bristles 86 are appropriately secured to the carrier plate 82. Each brush segment 80 extends arcuately for about ninety degrees (90°), and accordingly four brush segments 80 are disposed about a plate 12 to comprise a complete brush assembly 10. This may be understood from FIG. 2. The brush segments 80 are secured to the outer periphery of the plate 12 and each brush segment is held in place by a pair of bolts 50 and lock plates 60.

In order to release a brush segment 80 for removal and to add a new brush segment, the appropriate pair of bolts 50 are rotated to lower the plate 60 until the brush segment may be lifted clear of the pins 66. The old brush segment is then removed and a new brush segment 80 is inserted and secured to the plate 12 by reversing the removal process or steps.

For inserting a brush segment 80, the brush segment is moved inwardly until the aperture 84 is aligned with the pin 66. This is accomplished by a workman visually aligning the aperture 84 with the pin 66 by viewing through the viewing aperture 42. When the apertures 84 are aligned with the pins 66, the brush segment is dropped downwardly onto the pins 66. This may be understood from the large vertical arrow in FIG. 5B. The bolts 50 are then rotated, as may be understood from the curved arrow in FIG. 5C, to move the plates 60 and the brush segment 80 upwardly. With the pins 66 extending through the apertures 84, a brush segment is secured to the bottom 15 of the plate 12.

It will be noted that the sleeve 44 serves a dual function, in addition to providing strength or support, as has been discussed above. The sleeve 44 helps to guide the plate 60 relative to the shank 54, the bolt 50, and at the same time it may provide a limit or stop for the plate 60 relative to the carrier plate 82. The sleeves 44 and the support webs 28 and 36 also help to provide structural support for the brush segments 80 in case of contact with a curb, as so often happens, and as has been commented on above.

And, as may be understood from FIG. 4, the support webs 28 and 36 also help to guide the brush segments 80 during a change of the segments. Each segment includes two angular faces 88 and 90 which are disposed respectively adjacent to the webs 28 and 36. During installation, the webs 28 and 36 act as stop to limit the inward movement of the segments 80.

As may be observed from the hatching of the carrier plate 82, the carrier plate 82 is typically made out of plastic material. Overly tightening the plate 60 against the bottom of the carrier plate 82 could result in the cracking and thus a failure of the base plate 82. However, with the sleeve 44 acting as a stop, the upward movement of the plate 60 is limited so that such over stressing or stressing of the carrier plate 82 does not happen.

In addition, the use of the pins 66 and the plates 60 which contact the brush carrier plate 82, together with the support webs 28 and 36, provides additional support for the carrier plates 82 to help them resist cracking, etc., in case of a contact with a curb, etc.

Referring again to FIG. 4, it will be noted that the carrier plate 82 includes a pair of angular faces 88 and 90 which are disposed against the support webs 28 and 36, respectively. The juxtaposition relationship helps to guide and provide extra support for the carrier plate 82 and the brush segment 80.

Referring again to FIGS. 5A, 5B, and 5C, it will be noted that a brush segment 80 includes a generally flat top surface 92 and a generally flat bottom surface 94. The apertures or holes 84 extend through the carrier plate 82 between the top and bottom surfaces 92 and 94, respectively. The holes or apertures 84 are preferably uniform for stability.

The generally flat top surface 92 and generally flat bottom surface 94 provide mating surfaces for the bottom surface 15 of the plate or disk 12 and for the generally flat top surface of the lock plate 60, respectively.

The mating flat surfaces provide stability and help to reduce cracking, breaking, etc., of the segment 80 during use, and particularly in case of contact with a curb, etc.

Figure 6A:
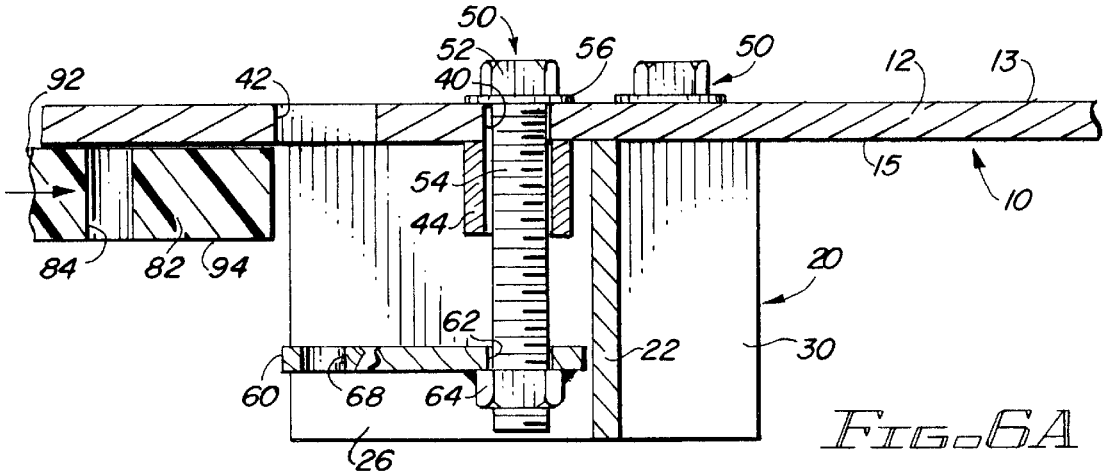
FIG. 6A is a view in partial section of an alternate embodiment of the present invention.
Figure 6B:
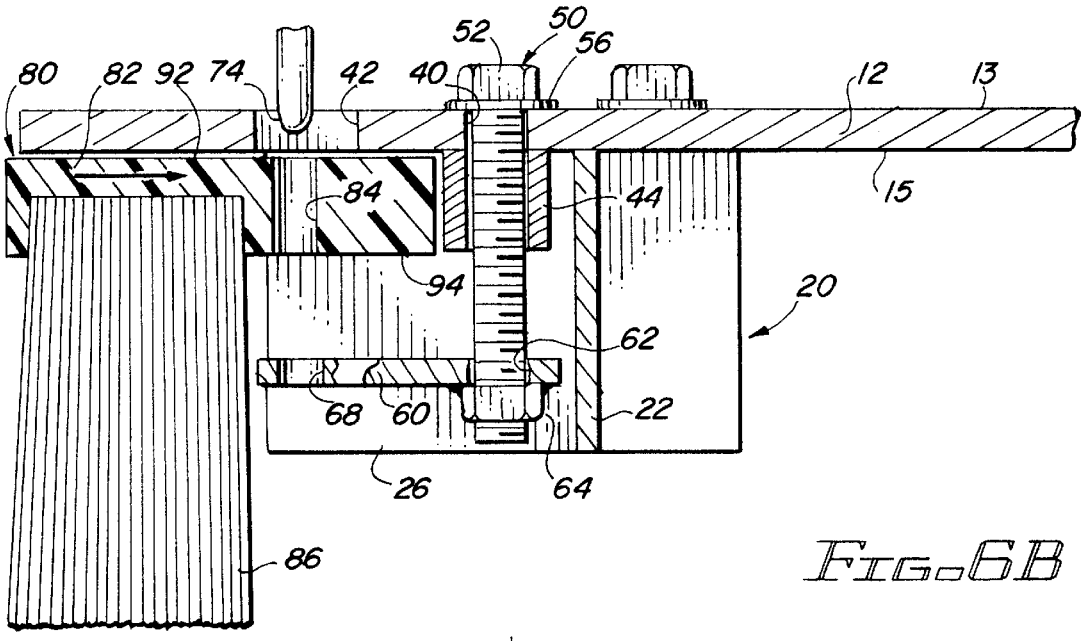
FIG. 6B is a view in partial section sequentially following FIG. 6A.
Figure 6C:
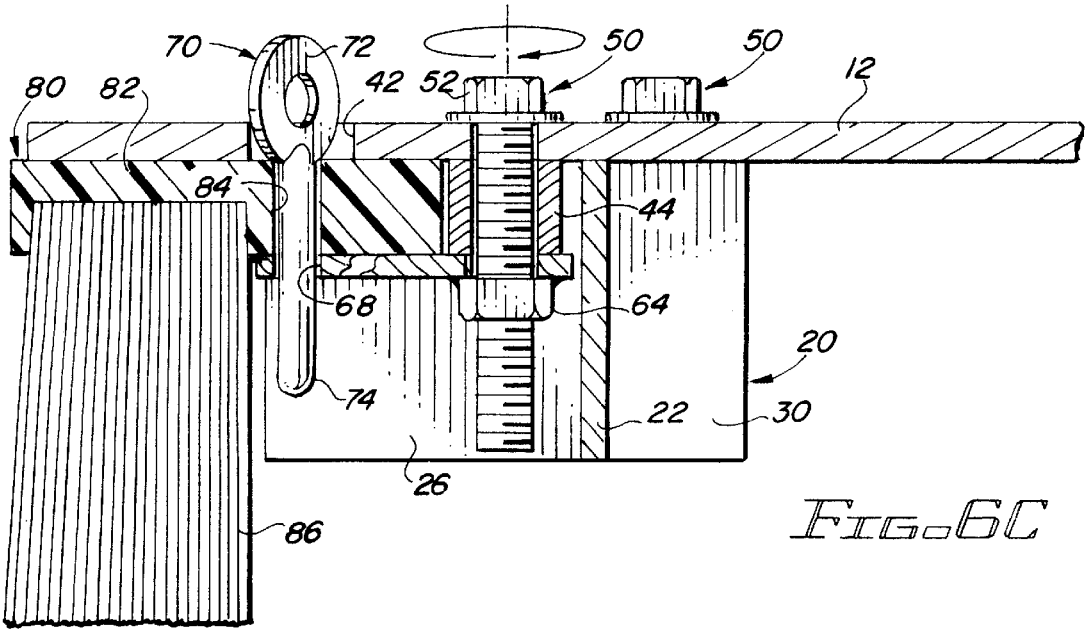
FIG. 6C is a view in partial section sequentially following FIG. 6B.

FIG. 6A is a view in partial section of an alternate embodiment of the apparatus 10 of the present invention, comprising an alternate way of securing the brush segments 80 to the disc 12. FIG. 6B is a view in partial section sequentially following FIG. 6A, and FIG. 6C is a view in partial section sequentially following FIG. 6B. For the following discussion, reference will primarily be made to FIGS. 6A, 6B, and 6C.

In the embodiment illustrated in FIGS. 6A, 6B, and 6C, the pin 66 has been removed from the lock plate 60 and is replaced by a separate pin 70. An aperture 68 extends through the lock plate 60 and receives the pin 70 when the aperture 84 in the brush segment is aligned with the aperture 42 in the plate 12 and with the aperture 68 in the lock plate 60.

The pin 70 includes a shank 74 and an upper ring portion 72. The diameter of the ring portion 72 is greater than the diameter of the aperture 84 in the brush segment 80, and accordingly will extend through the aperture 42 in the plate 12 but will not extend through the aperture 84 in the brush segment 80. The shank 74 extends through the aperture 84 in the brush segment 80 and into the aperture 68 in the lock plate 60 to secure the three elements together.

When the bolt 50 is rotated to raise the lock plate 60, after the brush segment 80 is appropriately fitted, with the apertures 68, 84, and 42, aligned, the pin 70 is then dropped or inserted through the aligned apertures 42, 84, and 68. The bolt 50 is rotated until the lock plate 60 is securely disposed against the bottom of the brush segment 80. With the pin 70 in the aligned apertures, the brush segment 80 is then securely held in place against the plate 12.

Other than the aperture 68 and the lock plate 60, and the use of a free pin 70, the face plate or disc 12, the brush segment 80, and the lock plate 60 remain substantially as discussed above in conjunction with FIGS. 1–5B.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Brush apparatus comprising in combination:

a disk having a top side and a bottom side for receiving a brush segment;

a brush segment to be secured to the bottom side of the disk and having a first aperture;

lock plate means secured to the disk and movable upwardly and downwardly relative to the disk including a second aperture in the disk, a bolt having a threaded shank extending through the second aperture, a lock plate, and threaded means on the lock plate for receiving the threaded shank on the bolt whereby rotation of the bolt moves the lock plate upwardly and downwardly; and pin means including a pin extending into the first aperture for securing the brush segment to the disk as the lock plate is moved upwardly against the brush segment.

2. The apparatus of claim 1 in which the pin means includes a third aperture in the lock plate and the pin extends through the first aperture in the brush segment and through the third aperture in the lock plate.

3. The apparatus of claim 1 in which the pin is secured to the lock plate and movable into the first aperture in the brush segment as the lock plate is moved upwardly.

4. The apparatus of claim 1 in which the disk includes a fourth aperture aligned with the first aperture in the brush segment.

5. The apparatus of claim 1 in which the lock plate means further includes bracket secured to the bottom side of the disk for guiding the lock plate upwardly and downwardly in response rotation of the bolt.

6. Brush apparatus comprising in combination:

plate means including a plate having a top side and a bottom side for receiving a brush segment;

a first aperture extending through the plate;

a bolt having a threaded shank extending through the first aperture;

a lock plate;

an aperture in the lock plate;

threaded means on the lock plate for receiving the threaded shank of the bolt whereby rotation of the bolt moves the lock plate upwardly and downwardly;

a second aperture extending through the plate;

a pin extending through the second aperture;

a brush segment to be secured to the plate, including a first aperture for receiving the pin, whereby rotation of the bolt moves the lock plate upwardly to lock the brush segment to the plate means.

7. The apparatus of claim 6 in which the plate means further includes a bracket for guiding the lock plate.

8. The apparatus of claim 7 in which the bracket is secured to the bottom side of the plate.

9. The apparatus of claim 8 in which the bracket comprises a generally U-shaped channel in which the lock plate moves in response to rotation of the bolt.

10. The apparatus of claim 8 in which the bracket includes a pair of support webs, and the brush segment is disposed adjacent to the support webs.

11. The apparatus of claim 6 in which the plate means further includes a sleeve secured to the bottom side of the plate and aligned with the first aperture of the plate for guiding the bolt.

12. The apparatus of claim 6 in which the threaded means comprises a bolt receiving aperture and a nut secured to the lock plate at the bolt receiving aperture.

13. The apparatus of claim 6 in which the brush segment includes a generally flat top disposed against the bottom side of the plate and a generally flat bottom disposed against the lock plate.

* * * * *